US006016933A

United States Patent [19]

Daily et al.

[11] Patent Number: 6,016,933

[45] Date of Patent: Jan. 25, 2000

[54] FLOATING COOLER WITH REMOVABLE BASE

[76] Inventors: Craig Daily; Nair Daily, both of 11704 E. 74th Ter., Kansas City, Mo. 64133

[21] Appl. No.: 09/078,710

[22] Filed: May 14, 1998

[51] Int. Cl.[7] ..... B65D 43/24

[52] U.S. Cl. ..... 220/560

[58] Field of Search ..... 220/560

[56] References Cited

U.S. PATENT DOCUMENTS

| | | | |
|---|---|---|---|
| 2,531,562 | 11/1950 | Eve | 220/560 |
| 3,367,525 | 2/1968 | Elder | 220/560 |
| 4,871,079 | 10/1989 | Doucette et al. | 220/560 |
| 4,927,041 | 5/1990 | Hepburn | 220/560 |
| 5,447,764 | 9/1995 | Langford | 220/560 |
| 5,727,709 | 3/1998 | Nobile | 220/560 |

*Primary Examiner*—Joseph M. Moy

[57] ABSTRACT

A floating beverage cooler is provided including a floatable base and a cooler removably coupled to the base. The base has at least one recess formed therein for releasably receiving a beverage therein. The cooler and base further have a coupling mechanism for precluding the separation thereof.

9 Claims, 2 Drawing Sheets

FLOATING COOLER WITH REMOVABLE BASE

BACKGROUND OF THE INVENTION

1. Field of the Invention

The present invention relates to floating cup holders and more particularly pertains to a new floating cooler with removable base for allowing the convenient use of a cooler on a body of water.

2. Description of the Prior Art

The use of floating cup holders is known in the prior art. More specifically, floating cup holders heretofore devised and utilized are known to consist basically of familiar, expected and obvious structural configurations, notwithstanding the myriad of designs encompassed by the crowded prior art which have been developed for the fulfillment of countless objectives and requirements.

Known prior art floating cup holders include U.S. Pat. No. 4,927,041; U.S. Pat. No. 4,871,079; U.S. Pat. Des. No. 307,854; U.S. Pat. No. 5,628,658; U.S. Pat. No. 3,015,406; and U.S. Pat. No. 1,324,305.

In these respects, the floating cooler with removable base according to the present invention substantially departs from the conventional concepts and designs of the prior art, and in so doing provides an apparatus primarily developed for the purpose of allowing the convenient use of a cooler on a body of water.

SUMMARY OF THE INVENTION

In view of the foregoing disadvantages inherent in the known types of floating cup holders now present in the prior art, the present invention provides a new floating cooler with removable base construction wherein the same can be utilized for allowing the convenient use of a cooler on a body of water.

The general purpose of the present invention, which will be described subsequently in greater detail, is to provide a new floating cooler with removable base apparatus and method which has many of the advantages of the floating cup holders mentioned heretofore and many novel features that result in a new floating cooler with removable base which is not anticipated, rendered obvious, suggested, or even implied by any of the prior art floating cup holders, either alone or in any combination thereof.

To attain this, the present invention generally comprises a base having a pair of parallel, elongated side portions each having a cylindrical configuration. Integrally coupled between ends of the side portions are a pair of short end portions each having a rectangular configuration. As shown in FIG. 1, each of the short end portions is equipped with a height equal to a diameter of the elongated side portions. Further, a bottom plate is coupled within an interior periphery of the portions and flush with a bottom surface thereof. As shown in FIG. 1, the bottom plate has an elongated slot being situated along a central extent thereof in parallel with the side portions. For containing beverages therein, each of the short end portions has a pair of cylindrical recesses formed in a top surface adjacent to ends thereof. An outer side face of each short end portion has a tie down anchor mounted thereon for reasons that will soon become apparent. Next provided is a cooler with a rectangular configuration including a bottom face and a peripheral side wall integrally coupled to the bottom face and extending upwardly therefrom. As such, the cooler has an interior space and an open top. A planar rectangular lid is also included and is defined by a pair of short edges and a pair of elongated edges. One of such elongated edges is hingably coupled to the side wall for selectively closing the cooler. For engaging the elongated slot formed on the base, the bottom face of the cooler has an unillustrated elongated protrusion. The peripheral side wall further has a pair of tie down anchors mounted thereon for being coupled to those of the base for securement purposes. With reference now to FIG. 2, a pair of retractable cup holders are included each with an upper extent having a rectangular tab with an annular ring mounted to an outboard end thereof. In use, the upper extent is adapted to be slidably retracted within a recess formed in one of the short edges of the lid of the cooler. Each retractable cup holder further includes a plurality of intermediate annular portions having an upper peripheral lip for slidably engaging an upper adjacent intermediate annular portion. The cup holders further include a bottommost annular portion with a closed bottom. By this structure, the intermediate and bottommost annular portions are capable of being collapsed into a single plane for being inserted within the recess when stored. Further, the annular portions work together to define a frusto-conical container for containing beverages when deployed.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new floating cooler with removable base apparatus and method which has many of the advantages of the floating cup holders mentioned heretofore and many novel features that result in a new floating cooler with removable base which is not anticipated, rendered obvious, suggested, or even implied by any of the prior art floating cup holders, either alone or in any combination thereof.

It is another object of the present invention to provide a new floating cooler with removable base which may be easily and efficiently manufactured and marketed.

It is a further object of the present invention to provide a new floating cooler with removable base which is of a durable and reliable construction.

An even further object of the present invention is to provide a new floating cooler with removable base which is susceptible of a low cost of manufacture with regard to both materials and labor, and which accordingly is then susceptible of low prices of sale to the consuming public, thereby making such floating cooler with removable base economically available to the buying public.

Still yet another object of the present invention is to provide a new floating cooler with removable base which provides in the apparatuses and methods of the prior art some of the advantages thereof, while simultaneously overcoming some of the disadvantages normally associated therewith.

Still another object of the present invention is to provide a new floating cooler with removable base for allowing the convenient use of a cooler on a body of water.

Even still another object of the present invention is to provide a new floating cooler with removable base that includes a floatable base and a cooler removably coupled to the base. The base has at least one recess formed therein for releasably receiving a beverage therein. The cooler and base further have a coupling mechanism for precluding the separation thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
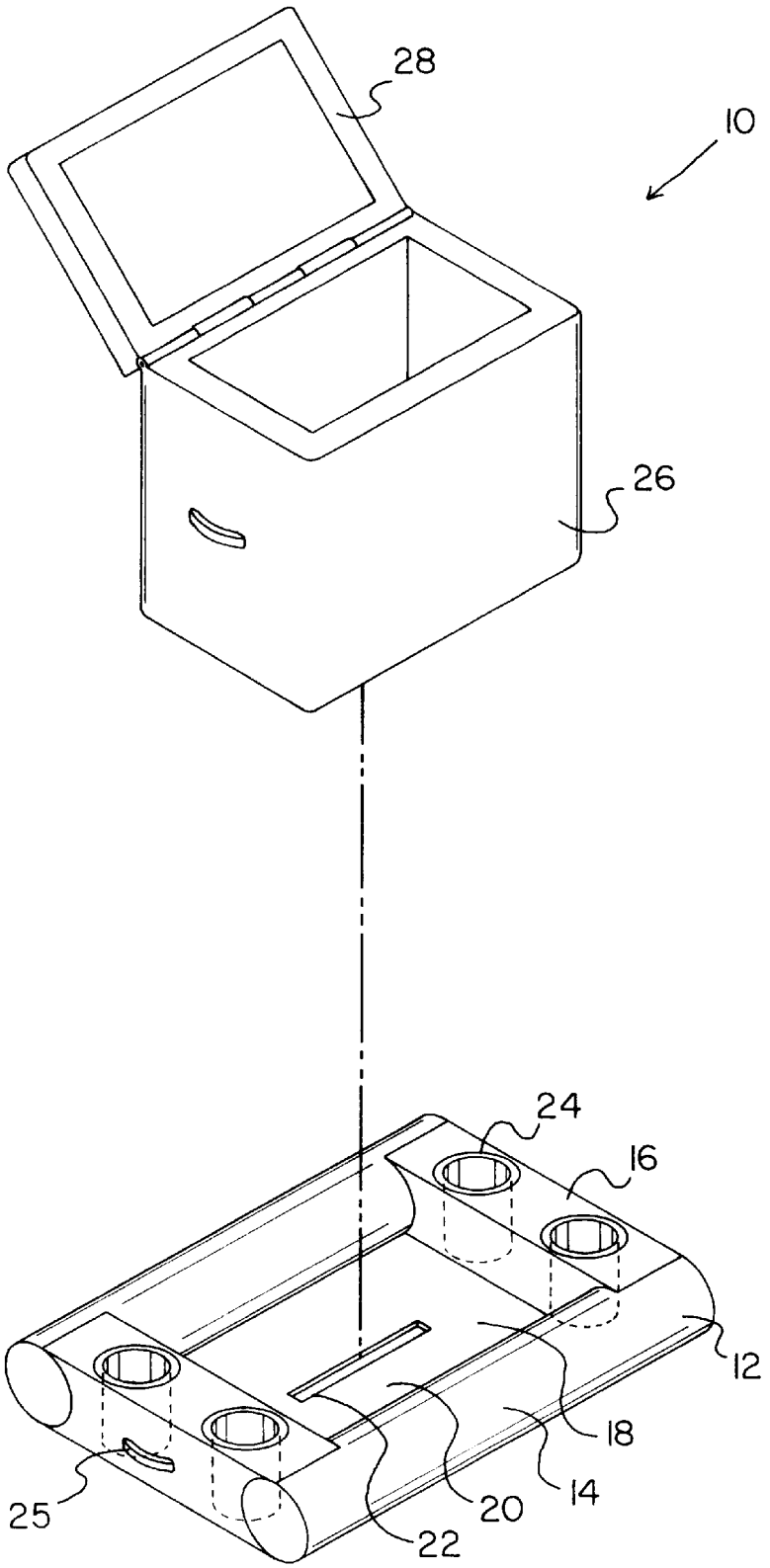
FIG. 1 is an exploded perspective view of a new floating cooler with removable base according to the present invention.
Figure 2:
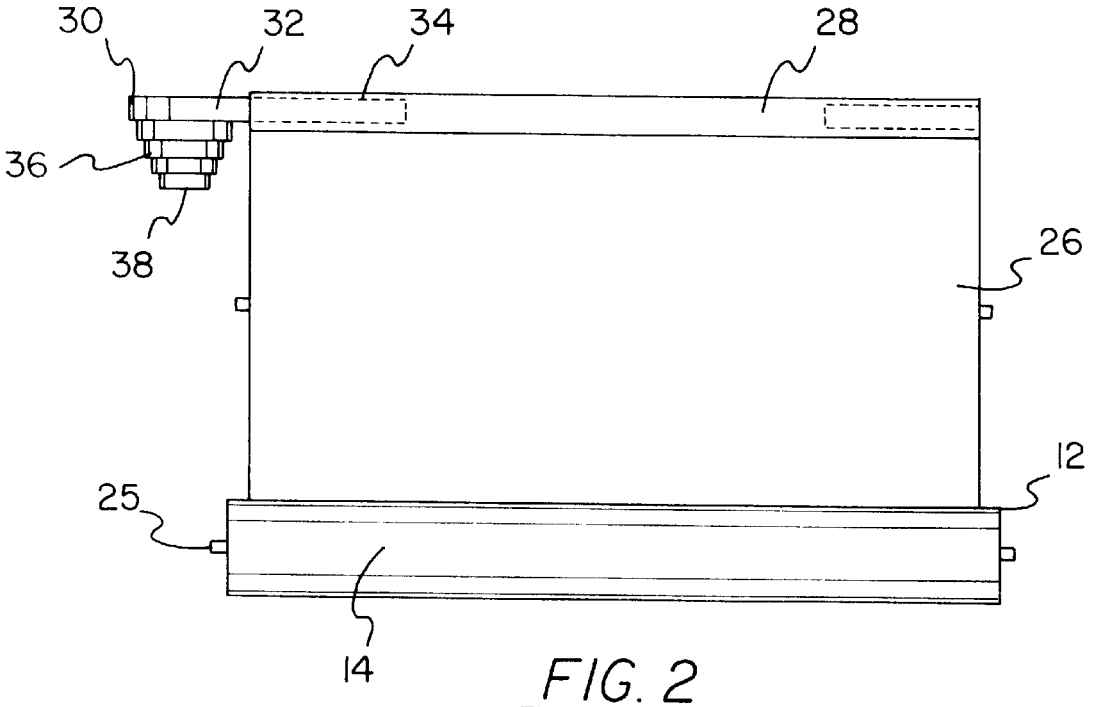
FIG. 2 is a side view of the present invention.
Figure 3:
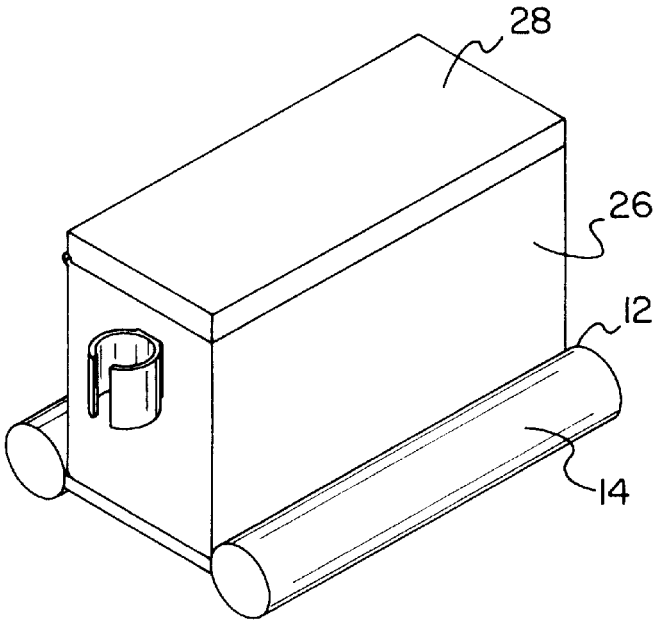
FIG. 3 is a perspective view of the present invention.

With reference now to the drawings, and in particular to FIGS. 1 through 3 thereof, a new floating cooler with removable base embodying the principles and concepts of the present invention and generally designated by the reference numeral 10 will be described.

The present invention, designated as numeral 10, includes an inflatable or foam base 12 having a pair of parallel, elongated side portions 14 each having a cylindrical configuration. Integrally coupled between ends of the side portions is a pair of short end portions 16 each having a rectangular configuration. As shown in FIG. 1, each of the short end portions is equipped with a height equal to a diameter of each elongated side portion. Further, a bottom plate 18 is coupled within an interior periphery of the portions and flush with a bottom surface thereof. By this structure, a recess 20 is defined.

As shown in FIG. 1, the bottom plate has an elongated slot 22 being situated along a central extent thereof in parallel with the side portions. For containing beverages therein, each of the short end portions has a pair of cylindrical recesses 24 formed in a top surface thereof. An outer side face of each short end portion has a tie down anchor 25 mounted thereon for reasons that will soon become apparent.

Next provided is a cooler 26 with a rectangular configuration including a bottom face and a peripheral side wall integrally coupled to the bottom face and extending upwardly therefrom. As such, the cooler has an interior space and an open top. A planar rectangular lid 28 is also included and is defined by a pair of short edges and a pair of elongated edges. One of such elongated edges is hingably coupled to the side wall for selectively closing the cooler. For engaging the elongated slot formed on the base, the bottom face of the cooler has an unillustrated elongated protrusion. The peripheral side wall of the cooler further has a pair of tie down anchors mounted thereon for being coupled to those of the base for securement purposes. Each tie down anchor of the present invention includes an arcuate rigid bar coupled to the recipient surface at the ends thereof. A rope, strap, Velcro or the like may be used to couple the tie down anchors.

With reference now to FIG. 2, a pair of retractable cup holders 30 are included each with an upper extent 32 having a rectangular tab with an annular ring mounted to an outboard end thereof. In use, the upper extent is adapted to be slidably retracted within a recess 34 formed in one of the short edges of the lid of the cooler. Each retractable cup holder further includes a plurality of intermediate annular portions 36 having an upper peripheral lip for slidably engaging an upper adjacent intermediate annular portion. Each annular portion further has a lower peripheral lip for constraining movement of the upper peripheral lip of an adjacent annular portion. The cup holders further include a bottommost annular portion 38 with a closed bottom.

By this structure, the intermediate and bottommost annular portions are capable of being collapsed into a single plane for being inserted within the recess when stored. Further, the annular portions work together to define a frusto-conical container for containing beverages when deployed.

As an option, a fixed cup holder may be mounted to the peripheral side wall of the cooler. Such fixed cup holder includes a resilient clip with a C-shaped horizontal cross-section along its height. Note FIG. 3. The clip is thus defined by a pair of arcuate portions that may be biased for allowing the securement of a beverage therein.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A floating beverage cooler comprising, in combination:

a base including a pair of parallel, elongated side portions each having a cylindrical configuration, a pair of short end portions each having a rectangular configuration and integrally coupled between ends of the side portions with a height equal to a diameter of the side portions, and a bottom plate coupled within an interior periphery of the portions flush with a bottom surface thereof, the bottom plate having an elongated slot being situated along a central extent thereof in parallel with the side portions, each of the short end portions having a pair of cylindrical recesses formed in a top surface adjacent to ends thereof for containing beverages therein, wherein an outer side face of each short end portion has a tie down anchor mounted thereon;

a cooler with a rectangular configuration including a bottom face, a peripheral side wall integrally coupled to the bottom face and extending upwardly therefrom for defining an interior space and an open top, and a planar rectangular lid defined by a pair of short edges and a pair of elongated edges one of which is hingably coupled to the side wall for selectively closing the cooler, the bottom face of the cooler having an elongated protrusion for engaging the elongated slot formed on the base, the peripheral side wall further having a pair of tie down anchors mounted thereon for being coupled to those of the base for securement purposes; and a pair of retractable cup holders each having an upper extent including a rectangular tab with an annular ring mounted to an outboard end thereof, wherein the upper extent is adapted to be slidably retracted within a recess formed in one of the short edges of the lid of the cooler, each retractable cup holder further including a plurality of intermediate annular portions having an upper peripheral lip for slidably engaging an upper adjacent intermediate annular portion and a bottommost annular portion with a closed bottom, wherein the intermediate and bottommost annular portions are capable of being collapsed into a single plane for being inserted within the recess.

2. A floating beverage cooler comprising:

a floatable base having a pair of parallel cylindrical elongated side portions and a pair of end portions, each end portion extending between aligned ends of said side portions to define a generally rectangular space between said side portions and said end portions;

a planar bottom plate coupled to said base such that a bottom of said rectangular space is closed; and a cooler removably insertable into the rectangular space of the base such that said bottom plate supports said cooler for floatably supporting the cooler on a body of water, said base surrounding a portion of a peripheral wall of said cooler such that a lower portion of said cooler is nested in said base to block sliding of said cooler off of said base when said cooler and base are coupled together.

3. A floating beverage cooler as set forth in claim 2 wherein the base has at least one recess formed therein for releasably receiving a beverage therein.

4. A floating beverage cooler as set forth in claim 2 wherein both the cooler and base have a coupling means for precluding the separation thereof.

5. A floating beverage cooler as set forth in claim 4 wherein the coupling means includes a pair of tie down anchors situated on the cooler and base.

6. A floating beverage cooler as set forth in claim 4 wherein the coupling means includes a slot and groove mounted on the cooler and base.

7. A floating beverage cooler as set forth in claim 2 wherein the cooler has a retractable beverage holder mounted thereon.

8. A floating beverage cooler as set forth in claim 7 wherein the retractable beverage holder is slidably situated within a lid of the cooler.

9. A floating beverage cooler as set forth in claim 7 wherein the retractable beverage holder includes a plurality of concentric annular portion which are collapsible within a single plane.

* * * * *